US005352132A

United States Patent [19]

O'Keefe et al.

[11] Patent Number: 5,352,132

[45] Date of Patent: Oct. 4, 1994

[54] EXTENSION CORD

[76] Inventors: Michael S. O'Keefe, 236 Parkerville Rd., Southboro, Mass. 01772; Theodore Sares, 849 Main St., Wilbraham, Mass. 01095

[21] Appl. No.: 75,794

[22] Filed: Jun. 14, 1993

[51] Int. Cl.[5] ..... H01R 4/50

[52] U.S. Cl. ..... 439/346; 439/358

[58] Field of Search ..... 439/136, 137, 147, 269.1, 439/270, 345, 346, 347, 358, 901

[56] References Cited

U.S. PATENT DOCUMENTS

| | | | |
|---|---|---|---|
| 2,198,504 | 4/1940 | Pool | 173/343 |
| 2,307,592 | 1/1943 | Kuhlman | 439/269.1 |
| 3,226,667 | 12/1965 | Senior, Jr. | 439/346 X |
| 3,710,304 | 1/1973 | Warner et al. | 439/346 |
| 4,085,991 | 4/1978 | Marshall et al. | 439/346 |
| 4,136,919 | 1/1979 | Howard et al. . | |
| 4,909,749 | 3/1990 | Long | 439/263 |
| 4,925,396 | 5/1990 | Grover | 439/346 X |
| 4,969,833 | 11/1990 | Lindow et al. | 439/133 |
| 5,129,836 | 7/1992 | Ursich | 439/346 |
| 5,154,629 | 10/1992 | Carver et al. | 439/358 X |

FOREIGN PATENT DOCUMENTS 0532559 11/1956 Canada .

*Primary Examiner*—Khiem Nguyen
*Attorney, Agent, or Firm*—Steven N. Fox

[57] ABSTRACT

Disclosed is an extension cord generally comprising a waterproof socket which is adapted to receive a conventional plug. The socket comprises a pair of outwardly protruding buttons which when depressed, allow the plug to be inserted or removed from the socket. When the button is released, the plug is locked within the socket.

6 Claims, 3 Drawing Sheets

EXTENSION CORD

FIELD OF THE INVENTION

The present invention relates generally to electrical receptacles, and more particularly, to extension cords.

BACKGROUND OF THE INVENTION

Extension cords have been used for many years to lengthen the cord of an electrical device so that it can be connected to a power supply or receptacle. One end of the extension cord is formed with a socket or receptacle that is sized to engage with a plug located on the cord of the electrical device while the other end of the extension cord is formed with a plug which is adapted to engage with a socket located at the power supply.

Quite often, while the user is moving the electrical device or when the extension cord or cord of the device becomes entangled or otherwise caught, the extension cord will become disconnected from the device or power supply. When this occurs, the user is forced to discontinue operations and to re-establish the electrical connection, thereby adding additional time to complete the task. Yet worse, the extension cord may become partially disconnected from the receptacle, thereby leaving the "hot" electrical contacts exposed to the user and the environment. In this situation, a person may accidently come in contact with the electrical contacts and sustain sever injuries or the electrical contacts may become shorted thereby causing a fire and/or damage to the device, power supply or user.

In order to prevent the extension cord from becoming disconnected from the device, users have often resorted to means such as tying the cord of the device and the socket end of the extension cord into a knot to thereby isolate the plug/socket connection from any induced stress. This method, however, is time consuming, may damage the insulation surrounding the conductor, and shortens the effective length of the cord.

To overcome the above disadvantages, extension cords have been designed with a variety of locking mechanisms to securely connect the extension cord to the device or power supply. One such extension cord is shown in U.S. Pat. No. 4,085,991 (FIGS. 5 and 6) and includes a socket having a pair of legs 56 each of which are rotatably mounted about a pin 58. A finger 60 is mounted at the midpoint of each leg 56 and adapted so that when the leg 56 is rotated inward, the finger 60 becomes engaged with the apertures formed in plug 24. To remove the plug 24, the fingers 60 are compressed at a position above the pivot pin 58 which causes the legs 56 to rotate outwardly of the recess 44 and the fingers 60 to become disengaged from the apertures of the plug 24.

Extension cords of the type exemplified by U.S. Pat. No. 4,085,991, however, have several disadvantages. First, the legs which carry the fingers are completely exposed to the user and are pivoted about a pin. In order to successfully lock and unlock the extension cord, a user must apply pressure to the correct portion of the leg. Secondly, movement of the legs outside of the housing creates a spacing between the legs and the housing and an open passage between the environment and the electrical contacts of the socket. As such, a person's finger or clothes may become caught therein or the electrical contacts may become exposed to water or foreign materials which might create a dangerous working condition.

One object of the invention was to design an extension cord having a locking feature which could be easily actuated by the user.

Another object of the present invention was to design an extension cord that could be safely used in all types of weather conditions and working environments.

SUMMARY OF THE INVENTION

The present invention is an extension cord that generally comprises a waterproof socket and a cord. The socket comprises receptacles adapted to receive the prongs of a conventional plug. The socket further comprises a pair of buttons which protrude or extend out from the socket for easy access and actuation by a user.

To insert or remove the plug from the socket, a user must depress buttons which allows the plug to be fully inserted or removed from the receptacles. When the plug is inserted within the socket and buttons are released by the user, the plug becomes locked.

With the extension cord of the present invention, a user can easily "feel" or locate the buttons to provide quick insertion and/or removal of the plug from the socket. Further, because the socket is waterproof, a user may use the extension cord in a variety of weather conditions while reducing the chance of electrical related injuries.

BRIEF DESCRIPTION OF THE DRAWINGS

The following detailed description will become better understood with reference to the accompanying drawings in which.

DETAILED DESCRIPTION OF THE PREFERRED EMBODIMENT

Figure 1:
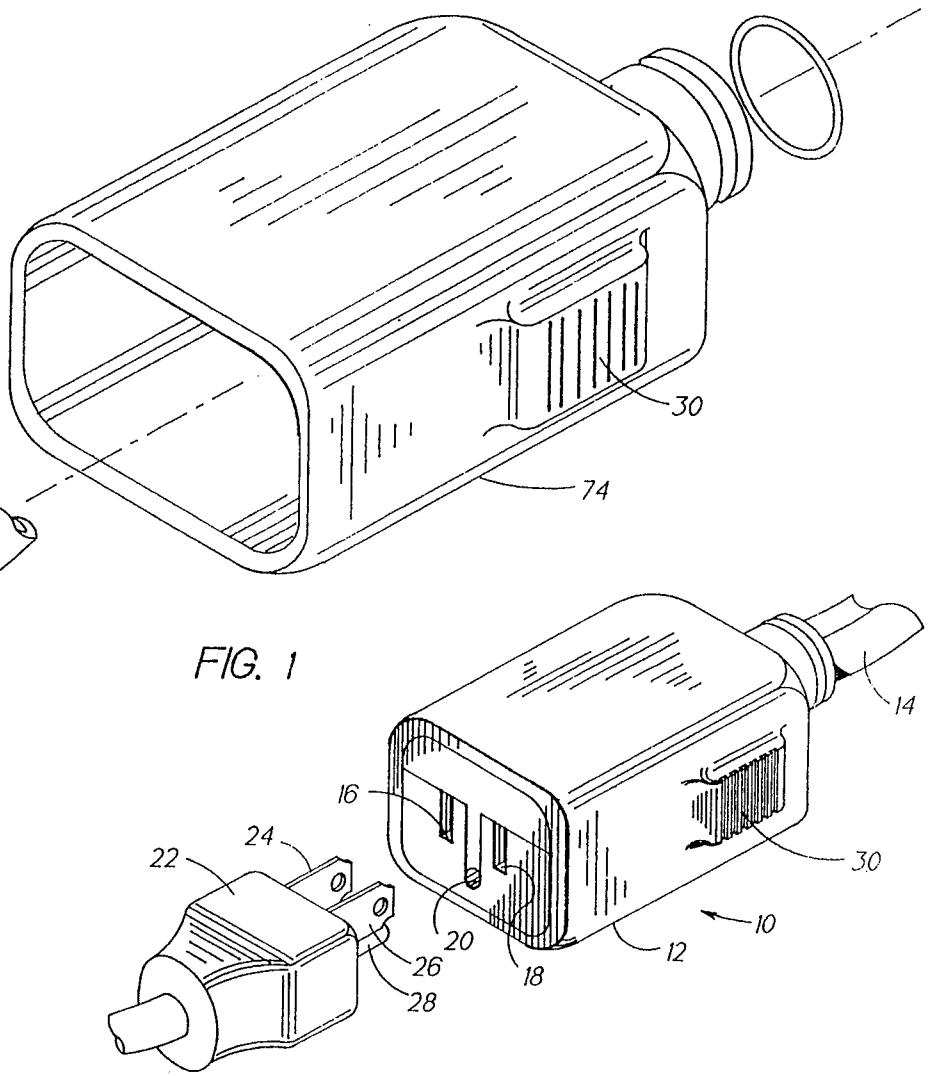
FIG. 1 is a perspective view of the present invention.

Referring to FIG. 1, where an extension cord 10 of the present invention is generally shown comprising a waterproof socket 12 and a cord 14. The socket 12 generally comprises receptacles 16, 18 and 20 adapted to receive prongs 24, 26, and 28 of a plug 22. The socket 12 also generally comprises a pair of buttons 30 which protrude or extend out from the socket 12 for easy access and actuation by a user.

To insert or remove the plug 22 from the socket 12, a user must depress buttons 30 which allows the prongs 24 and 26 of the plug 22 to be fully inserted or removed from receptacles 16 and 18. When the plug 22 is inserted within the socket 12 and buttons 30 are released by the user, the plug 22 becomes locked within the socket 12. With the extension cord 10 of the present invention, a user can easily locate the buttons 30 to provide quick insertion and/or removal of the plug 22 from the socket 12. Further, because socket 12 is waterproof, a user may use the extension cord 10 in a variety of weather conditions while reducing the chance of electrical related injuries.

Figure 2:
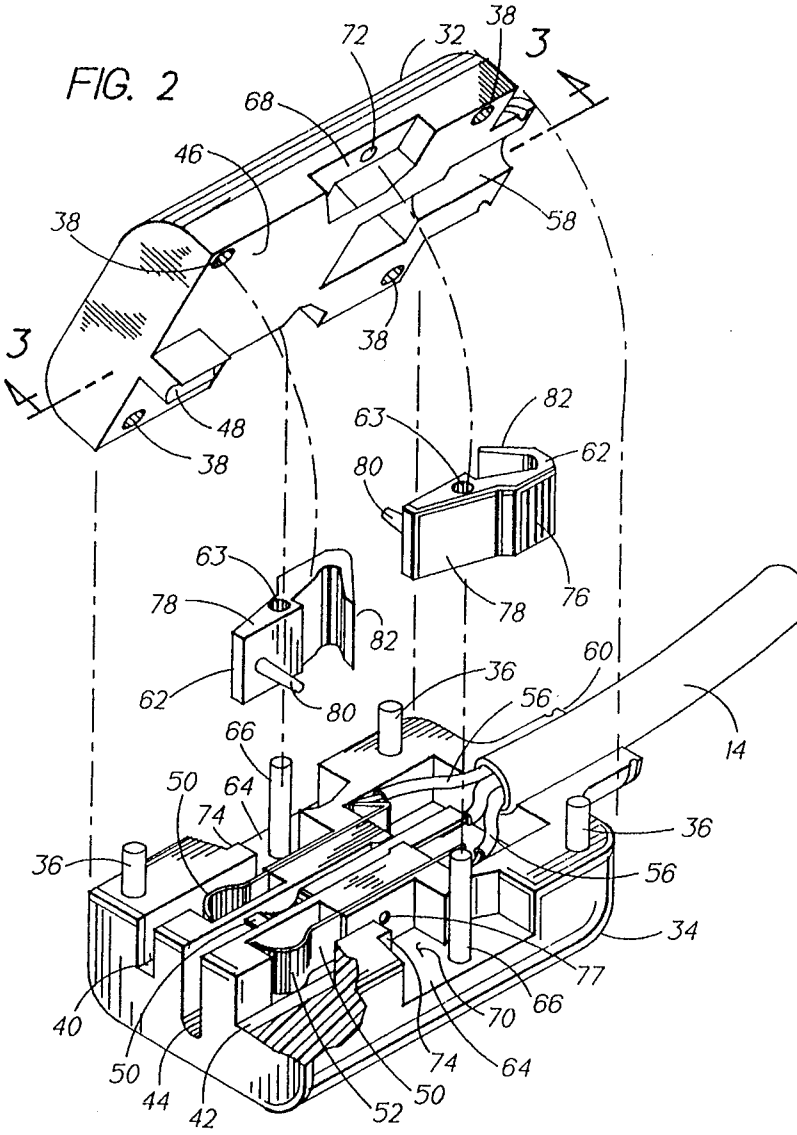
FIG. 2 is an exploded view showing the various components and assembly of the present invention.

Referring now to FIG. 2 where an exploded view shows the various components and assembly of the extension cord 10. The socket 12 generally comprises a lower housing 34 adapted to receive a variety of components (to be described) and a cover 32 which is fastened to lower housing 34 by a plurality of pins 36 and corresponding openings 38. The lower housing 34/cover 32 assembly is enclosed by a waterproof boot or cover 74. The boot 74 may be made from a premolded transparent or non-transparent polymer material while She lower housing 34 and cover 32 may be made from a rigid non-conductive material.

The lower housing 34 is formed with open channels 40, 42, and 44 each having an electrically conductive contact strip 50 disposed therein and secured by press-fit at the medial portion of the lower housing. One end of each contact strip 50 is formed with a hook or notch portion 52 which is configured to resiliently move as the prongs 24, 26, 28 of the plug 22 are inserted into the channels 40, 42, and 44. The other end of each contact strip 50 is soldered to wires 56 of the cord 14. The lower housing 34 further comprises a wire cavity 60 which allows the cord 14 and wires 56 to be positioned within lower housing 34.

The socket 12 further comprises a pair of levers 62, each of which are rotatably mounted within a cavity 64 formed in the lower housing 34 about a pin 66. Each of cavities 64 includes an opening 70 disposed adjacent to a wall 74 which provides communication with channels 40 or 42. Each of levers 62 comprise a thru-hole 63 adapted to receive pin 66, a medial portion 76 which protrudes outside of the lower housing 34 and which fits into the button 30 of the boot 74, an engagement portion 78 having a finger 80 connected or integral thereto, and a spring portion 82.

Figure 3:
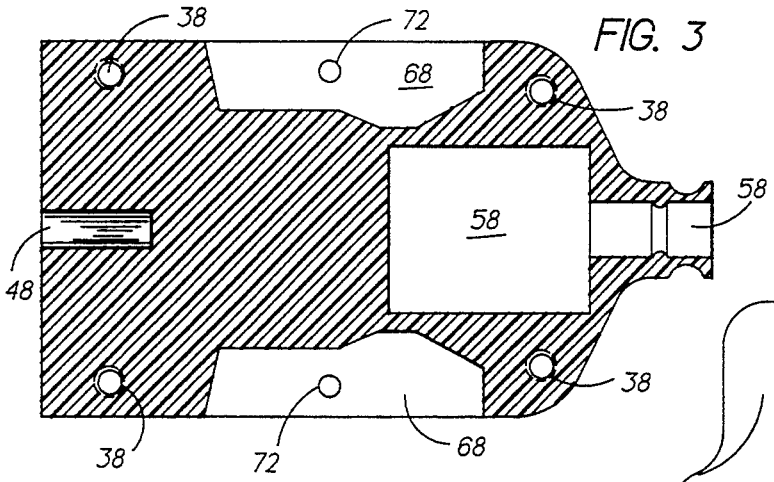
FIG. 3 is a cross-section view of the cover taken along line 3—3 of FIG. 2.

Referring to FIG. 3, the cover 32 is formed with a flat bottom portion 46, a protrusion 48 having a concave outer end, a pair of cavities 68, and a wire cavity 58. Each of cavities 68 comprise an opening 72 adapted to receive pins 66 mounted in the lower housing 34. When the cover 32 is fastened to the lower housing 34, the flat bottom portion 46 and protrusion 48 cooperate with channels 40 and 42, and 44, respectively, to form receptacles 16, 18 and 20. Similarly, cavities 68 and 58 align with cavities 64 and 60 of the lower housing 34 to enclose the levers 62 and the wires 56/cord 14.

Figure 4:
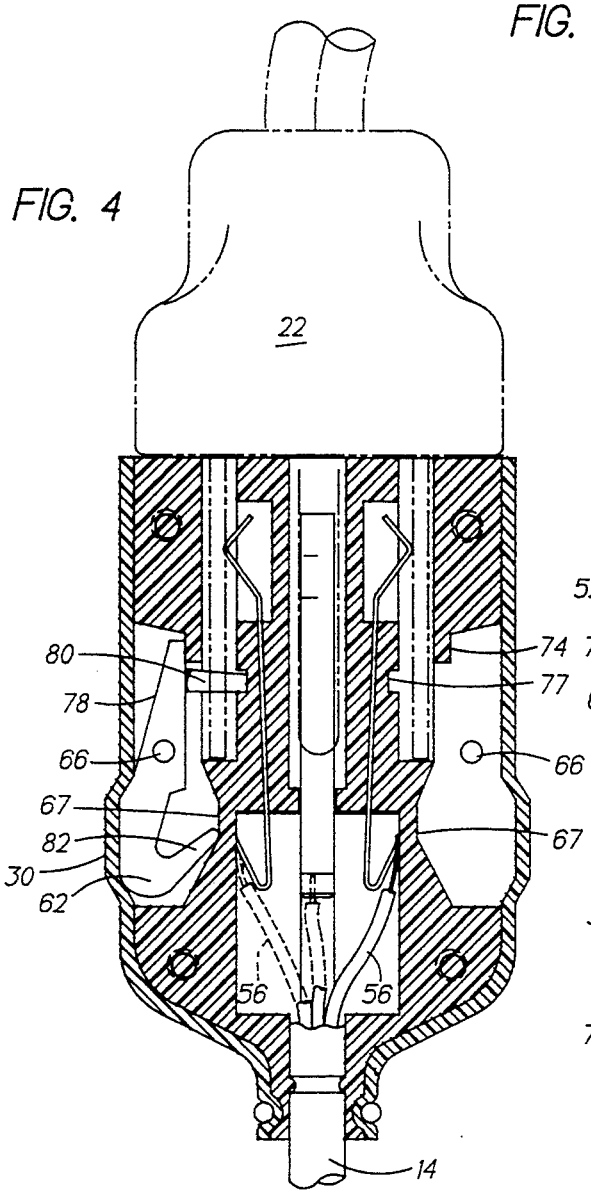
FIG. 4 is a cross-section view showing the present invention in a locked position.

Referring to FIG. 4, which shows the extension cord 10 in the assembled and normally "locked" position. In this view, one of the levers 62 has been removed for purposes of discussion and clarification. In the locked or normal position, each of levers 62 is mounted in their corresponding cavity 64 in a pre-loaded state such that the spring portion 82 is in compressive contact with a wall 67 of cavity 64 so as to thereby force the engagement portion 8 into contact with wall 74 and fingers 80 into recesses 77. The fingers 80 are tapered and designed such that when the plug 22 has been inserted, the fingers 80 pass through openings 25 provided in the prongs 24 and 26.

Figure 5:
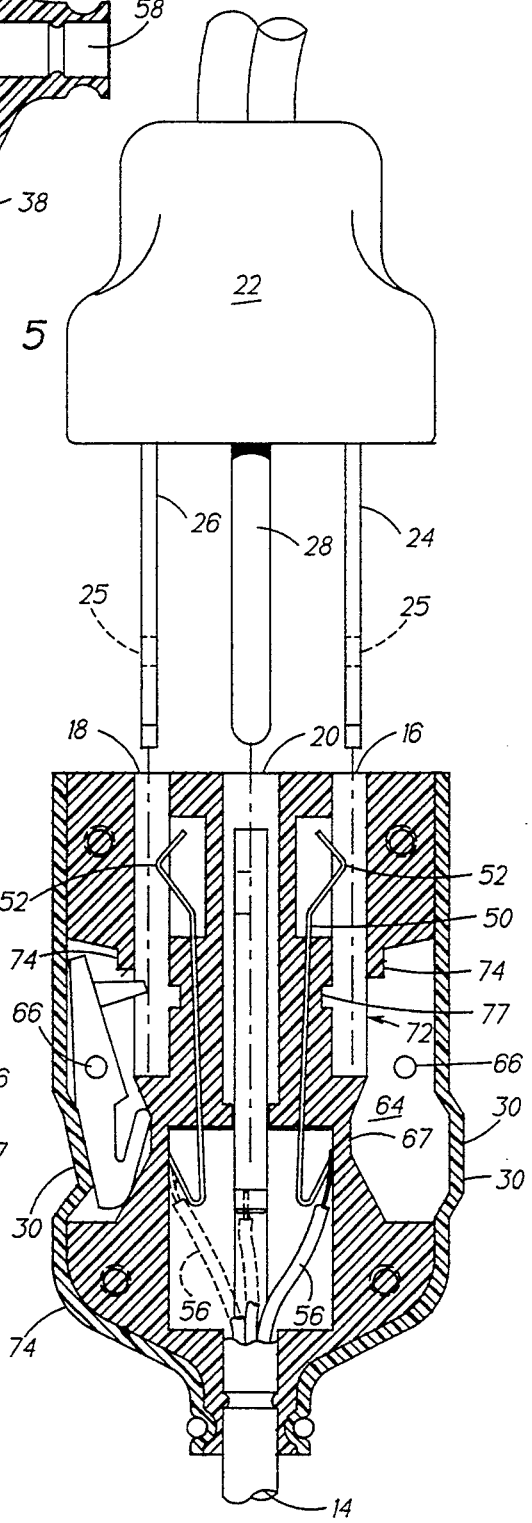
FIG. 5 is a cross-section showing the present invention in an unlocked position.
Figure 6:
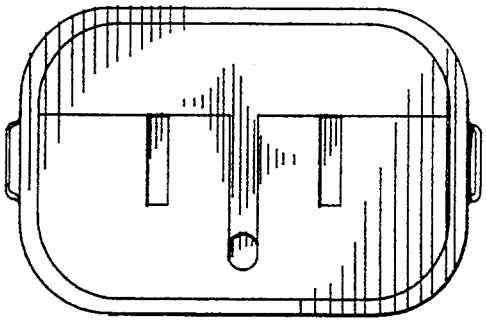
FIG. 6 is a front view of the present invention.
Figure 7:
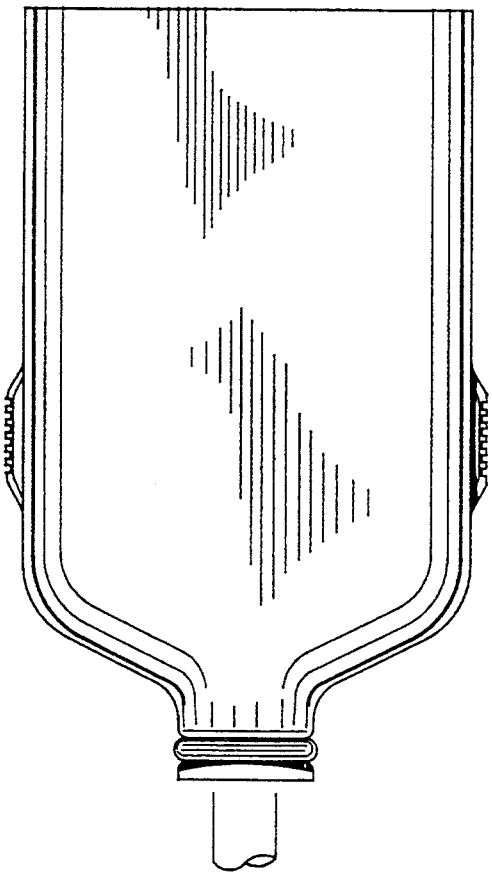
FIG. 7 is a top view of the present invention.
Figure 8:
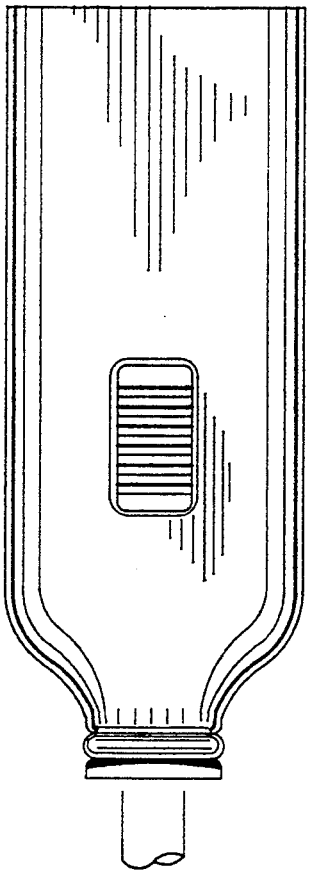
FIG. 8 is a side view of the present invention.
Figure 9:
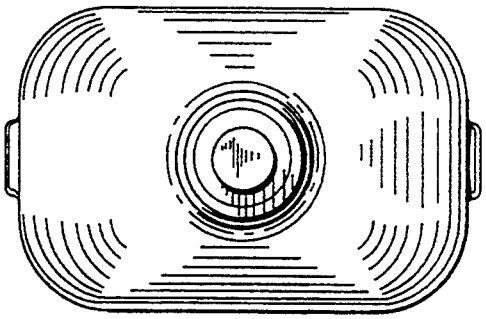
FIG. 9 is a rear view of the present invention.

Referring to FIG. 5, the extension cord 10 is shown with the buttons 30 and medial portions 76 of levers 62 depressed. Depression of the buttons 30 and the medial portions 76 of each lever 62 cause the spring portions 82 to compress against wall 67 of cavity 64 which in turn causes the levers 62 to rotate about pins 66. When the levers 62 are rotated to a predetermined position, the fingers 80 become disengaged from recesses 77 and clear of receptacles 16 and 18 so that the plug 22 may be inserted or removed from the socket 12.

FIGS. 6–9 show various plan views of the extension cord 10 which depict the ornamental appearance of the extension cord 10.

The extension cord 10 of the present invention is significantly safer and easier to operate than conventional devices. In particular, because the buttons 30 of boot 74 protrude outwardly, the user can easily "feel" or locate the button 30 and actuate the levers 62. Still further, boot 74 provides a waterproof electrical device which reduces the likelihood of electrocution should the extension cord 10 be used in wet or other hazardous environments.

Although in the preferred embodiment, the extension cord 10 includes the boot 74, the present invention may be easily embodied without the boot 74. In this embodiment, a user can easily operate the extension cord 10 because the medial portion 76 of levers 62 extends outwardly of the socket 12 thereby allowing quick access and actuation. Furthermore, the extension cord 10 is still safe to use because throughout rotation of each lever 62 there is still substantially no communication between the outside environment and the contact strips 50.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. An extension cord adapted to receive a plug having at least one prong and an aperture disposed in the prong, the extension cord comprises: a socket housing having at least one receptacle adapted to receive the prong; a cavity disposed adjacent to said receptacle and having a pin member disposed therein said socket housing is a two parts housing and said pin member being disposed on one of the housing part, said pin member being insertable in an aperture formed on the other housing part, said cavity being substantially accessible from a position outward of said socket housing; a lever rotatably mounted about said pin member and having a user actuated portion disposed outwardly of said cavity and said socket housing, and an engagement portion engagable with the aperture of the prong, whereby when said user actuated portion is depressed, said lever is moved to an unlocked position where said plug may be inserted into said socket housing and when said user actuated portion is released, said lever is moved to a locked position where said plug cannot be removed from said socket housing.

2. The extension cord of claim 1, further comprising a boot disposed about said socket housing and said user actuated portion.

3. The extension cord of claim 2, wherein said engagement portion and said user actuated portion are disposed on opposite sides of said pin member.

4. The extension cord of claim 3, wherein said engagement portion does not protrude outward of said cavity.

5. The extension cord of claim 2, wherein said lever further comprises a resilient member adapted to urge said lever to a locked position.

6. The extension cord of claim 5, wherein said user actuated portion and said resilient member are made from a single piece of material.

* * * * *